US008855524B2

(12) United States Patent
Nakajima et al.

(10) Patent No.: US 8,855,524 B2
(45) Date of Patent: Oct. 7, 2014

(54) DEVELOPING APPARATUS, PROCESS CARTRIDGE AND IMAGE FORMING APPARATUS

(75) Inventors: Keigo Nakajima, Nagoya (JP); Hiroshi Handa, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 176 days.

(21) Appl. No.: 13/049,974

(22) Filed: Mar. 17, 2011

(65) Prior Publication Data

US 2011/0236057 A1 Sep. 29, 2011

(30) Foreign Application Priority Data

Mar. 24, 2010 (JP) ..... 2010-067667

(51) Int. Cl.
*G03G 15/08* (2006.01)

(52) U.S. Cl.
CPC ..... *G03G 15/0817* (2013.01); *G03G 15/0812* (2013.01)
USPC ..... 399/103; 399/274; 399/284

(58) Field of Classification Search
CPC ..... G03G 15/0812; G03G 15/0817
USPC ..... 399/103, 274, 284
See application file for complete search history.

(56) References Cited

U.S. PATENT DOCUMENTS

| | | | | |
|---|---|---|---|---|
| 6,115,566 | A | 9/2000 | Ohara et al. | |
| 6,907,207 | B2 * | 6/2005 | Shoji et al. | 399/103 |
| 2001/0009618 | A1 | 7/2001 | Ohgoshi et al. | |
| 2002/0141778 | A1 * | 10/2002 | Itabashi | 399/103 |
| 2005/0111888 | A1 * | 5/2005 | Kim | 399/284 |
| 2006/0024085 | A1 | 2/2006 | Sato et al. | |

FOREIGN PATENT DOCUMENTS

| | | | |
|---|---|---|---|
| CN | 2828880 | Y | 10/2006 |
| CN | 201402369 | Y | 2/2010 |
| JP | 11125971 | A | 5/1999 |
| JP | 2000-131941 | | 5/2000 |
| JP | 2001-209247 | | 8/2001 |

OTHER PUBLICATIONS

CN Office Action mailed Jul. 4, 2012, CN Appln. 201110059603.5, English translation.

* cited by examiner

*Primary Examiner* — Benjamin Schmitt
(74) *Attorney, Agent, or Firm* — Banner & Witcoff, Ltd.

(57) ABSTRACT

A developing apparatus includes a housing; a developing roller; a seal member, and a layer thickness regulating member that contacts a circumferential surface of the developing roller via developer and regulates a thickness of a developer layer on the circumferential surface of the developing roller. The seal member has a sliding contact portion made of fiber having elasticity and sliding-contacting the circumferential surface of the developing roller. The layer thickness regulating member has one end portion that is supported by the housing and the other end portion to which a bent portion is formed to face the seal member, and the bent portion is configured to enter the sliding contact portion.

9 Claims, 13 Drawing Sheets

DEVELOPING APPARATUS, PROCESS CARTRIDGE AND IMAGE FORMING APPARATUS

CROSS REFERENCE TO RELATED APPLICATION

The present application claims priority from Japanese Patent Application No. 2010-067667, which was filed on Mar. 24, 2010, the disclosure of which is herein incorporated by reference in its entirety.

TECHNICAL FIELD

The present invention relates to an image forming apparatus that develops an electrostatic latent image formed on a photosensitive drum by using developer with a developing apparatus and transfers and outputs the developed image on a transfer medium, and a developing apparatus and a process cartridge that are used in the image forming apparatus.

BACKGROUND

In an image forming apparatus of an electro-photograph manner, an electrostatic latent image is formed on a surface of a photosensitive drum and toner that is developer is supplied to the electrostatic latent image on the photosensitive drum from a developing apparatus in which the toner is accommodated, so that a toner image is formed on the surface of the photosensitive drum. The toner image is transferred on a sheet, which is a transfer medium, so that an image is formed on the sheet.

As disclosed in Patent Document 1, the developing apparatus includes a housing having an opening that is opened toward the photosensitive drum, a developing roller that is rotatably supported to the housing and is arranged so that a circumferential surface thereof is exposed from the opening, a toner accommodating chamber in which toner is accommodated, a layer thickness regulating blade that regulates a thickness of a toner layer on the developing roller and a side seal member that prevents toner from being leaked from both end portions of a rotational axis line direction of the developing roller in the opening.

Furthermore, the layer thickness regulating member is configured by a stainless plate spring extending along the circumferential surface of the developing roller and has a leading end portion that is convexly bent to the circumferential surface of the developing roller.

In the meantime, the side seal member has a downstream-side side seal member that is arranged downstream of a rotational direction of the developing roller and an upstream-side side seal member that is arranged upstream of the rotational direction of the developing roller and sandwiches leading end portions of both ends of the layer thickness regulating blade by the downstream-side side seal member and the upstream-side side seal member.

[Patent Document 1] JP-A-2001-209247

SUMMARY

However, according to the above developing apparatus, in order to prevent toner leakage, the downstream-side side seal member, the housing and the leading end portion of the layer thickness regulating blade should be respectively fixed so that a gap is not generated, and furthermore, the upstream-side side seal member, the housing and the leading end portion of the layer thickness regulating blade should be respectively fixed so that a gap is not generated.

As described above, in the configuration in which the leading end portion of the layer thickness regulating blade is convexly bent, in order to prevent toner from being leaked from a rotational shaft direction of the developing roller, the side seal members should be assembled with high positioning precision so that, when fixing the housing and the upstream-side and downstream-side side seal members, the layer thickness regulating blade and the downstream-side side seal member and the side seal members and the layer thickness regulating blade, a space is not formed between both parties to be fixed.

The invention has been made to solve the above problem. An object of the invention is to provide a developing apparatus in which a space is hard to be generated and toner leakage is prevented without requiring high positioning precision when assembling a side seal member.

According to an illustrative aspect of the present invention, there is provided a developing apparatus comprising: a housing having an opening; a developing roller that is arranged so that a part of a circumferential surface of the developing roller is opposed to the opening of the housing, is rotatably supported to the housing and carries developer on the circumferential surface of the developing roller; a seal member that is fixed to the housing to be opposed to the developing roller in both end portions of the opening in a rotational axis line of the developing roller and sliding-contacts the circumferential surface of the developing roller, and a layer thickness regulating member that contacts the circumferential surface of the developing roller via developer and regulates a thickness of a developer layer on the circumferential surface of the developing roller, wherein the seal member has a sliding contact portion made of fiber having elasticity and sliding-contacting the circumferential surface of the developing roller, wherein the layer thickness regulating member has one end portion that is supported by the housing and the other end portion to which a bent portion is formed to face the seal member, and wherein the bent portion is configured to enter the sliding contact portion.

According to the illustrative aspect of the present invention, since the seal member has the sliding contact portion made of fiber having elasticity and the bent portion is configured to enter the sliding contact portion, the fiber easily fills a space between the housing and the developing roller and a space between the housing and the layer thickness regulating member by enabling the bent portion to enter the sliding contact portion. Thereby, when assembling the seal member, a space is hard to be generated and it is possible to prevent toner leakage without requiring high positioning precision.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

[Overall Configuration of Laser Printer]

Figure 1:
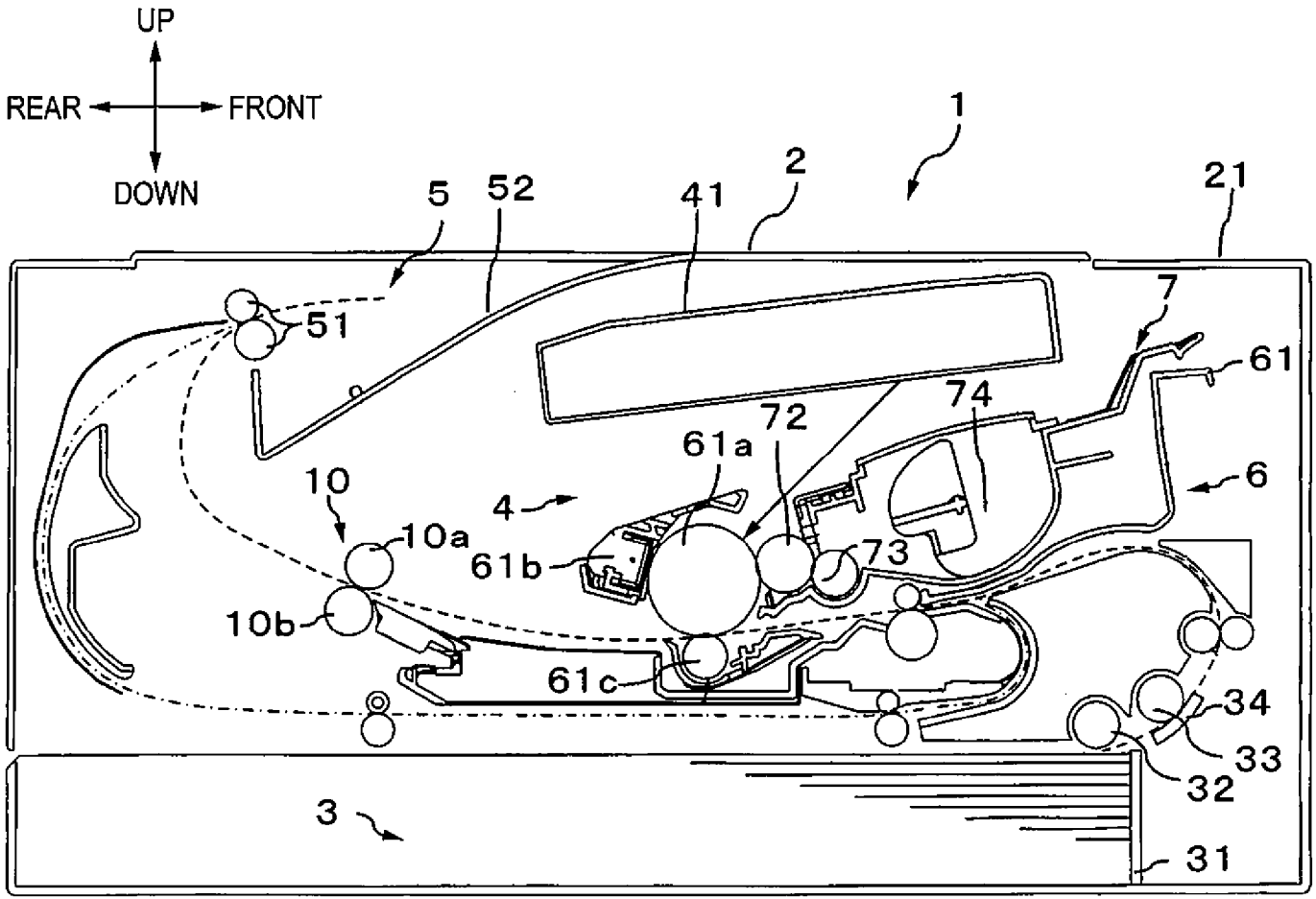
FIG. 1 is a side sectional view showing a schematic configuration of a laser printer.

FIG. 1 is a side sectional view showing a schematic configuration of a laser printer 1 that is an example of an image forming apparatus according to an illustrative embodiment.

The laser printer 1 has a body housing 2. The laser printer further has, in the body housing 2, a feeder unit 3 that feeds a sheet to an image forming unit, an image forming unit 4 that forms an image on the fed sheet and a sheet discharge unit 5 that discharges the sheet having an image formed thereon.

In the below descriptions, the upper and lower directions shown in FIG. 1 are referred to as upper and lower directions, the right side in FIG. 1 is referred to as a front side, the left side is referred to as a rear side, the inner side of paper is referred to as a right side and the front side of paper is referred to as a left side, unless particularly explained. The directions are set on the basis of direction when seen from a person standing at the front of the laser printer 1.

Figure 2:
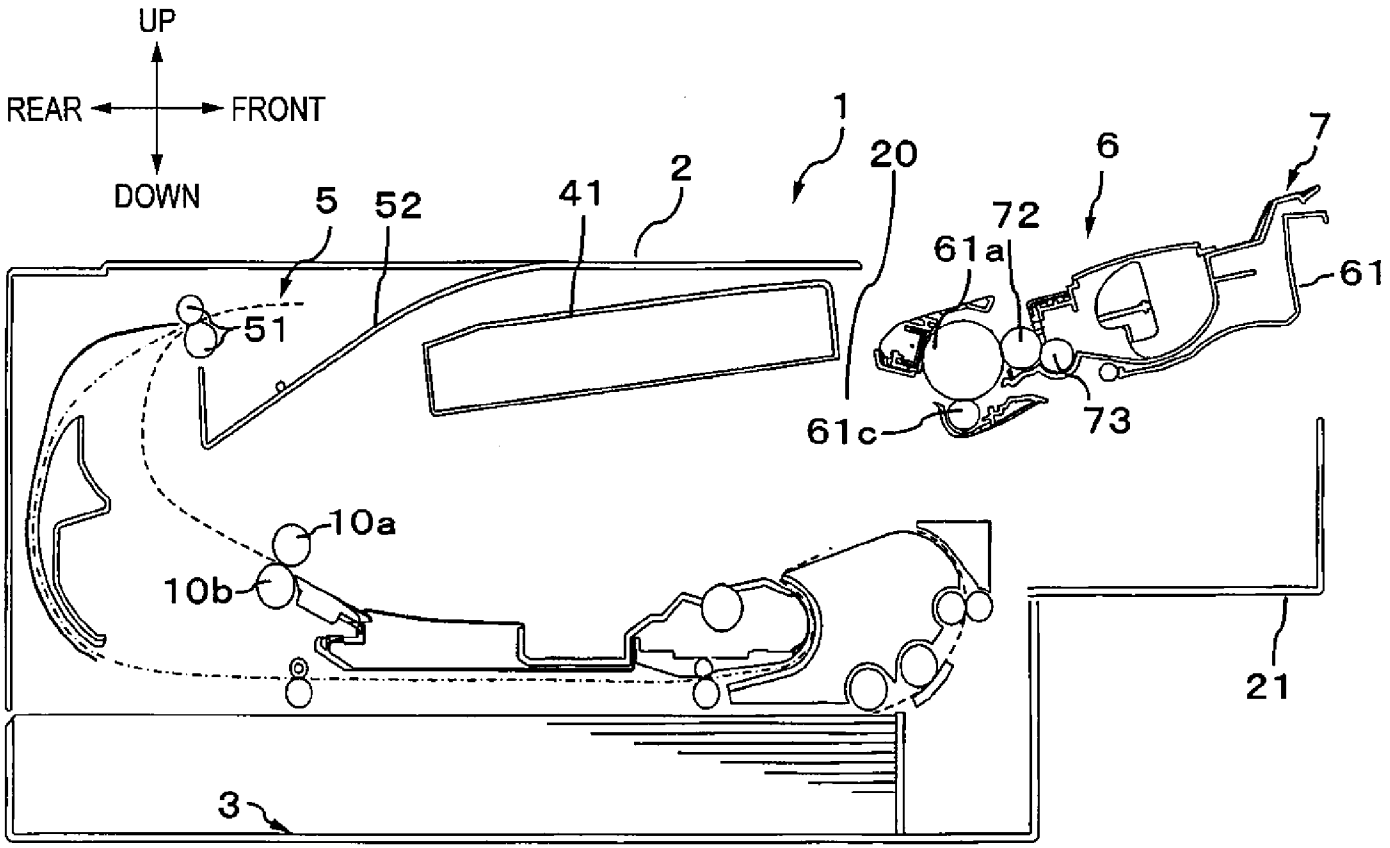
FIG. 2 is a side sectional view showing a laser printer in which a process cartridge is detached.

As shown in FIG. 2, the body housing 2 has an opening 20 and is provided with a cover 21 that can open and close the opening 20.

The cover 21 is rotatably supported to a cover shaft (not shown) that is provided at a lower end portion of the cover. When the cover 21 is closed (close state), the opening 20 is closed by the cover 21, as shown in FIG. 1. In addition, when the cover 21 is opened (open state), the opening 20 is opened and a process cartridge 6 that will be described below can be attached and detached through the opening 20, as shown in FIG. 2.

(1) Feeder Unit

The feeder unit 3 is provided at a lower part of the body housing 2. The feeder unit has a sheet feeding tray 6 that receives sheets, a pickup roller 32 that is provided above a front end portion of the sheet feeding tray 31 and a separation roller 33 and a separation pad 34, which are opposed to each other at a front side of the pickup roller 32.

In the feeder unit 3 configured as described above, the sheets from the sheet feeding tray 31 are separated one by one and then supplied to the image forming unit 4.

(2) Image Forming Unit

The image forming unit 4 has an exposure unit 41 that irradiates laser light on a surface of a photosensitive drum 61*a* to form an electrostatic latent image, a process cartridge 6 that transfers a toner image on a sheet and a photographic fixing unit 10 that heat-fixes the toner image on the sheet.

(2-1) Exposure Unit

The exposure unit 41 is provided at the upper of the body housing 2 and has a laser light emitting part, a polygon mirror, a lens and a reflector (not shown).

In the exposure unit 41 configured as described above, laser light emitted from a laser light source based on predetermined image data is scanned leftward and rightward at high speed by the polygon mirror, passes through the lens or is reflected by the reflector and is then irradiated on the photosensitive drum 61*a*.

(2-2) Process Cartridge

The process cartridge 6 is arranged below the exposure unit 41 and above the feeder unit 3 and is detachably mounted to the body housing 2. The process cartridge 6 has a drum cartridge 61 that configures an outside frame and a developing cartridge 7 (refer to FIG. 3) that is an example of the developing apparatus detachably mounted to the drum cartridge 61.

The drum cartridge 61 has a drum cartridge frame. The drum cartridge further has, in the drum cartridge frame, a photosensitive drum 61*a* that is rotatably supported to the drum cartridge frame, a charger 61*b* that charges the photosensitive drum 61*a* and a transfer roller 61*c* that transfers a toner image formed on the photosensitive drum 61*a* to a sheet.

Figure 3:
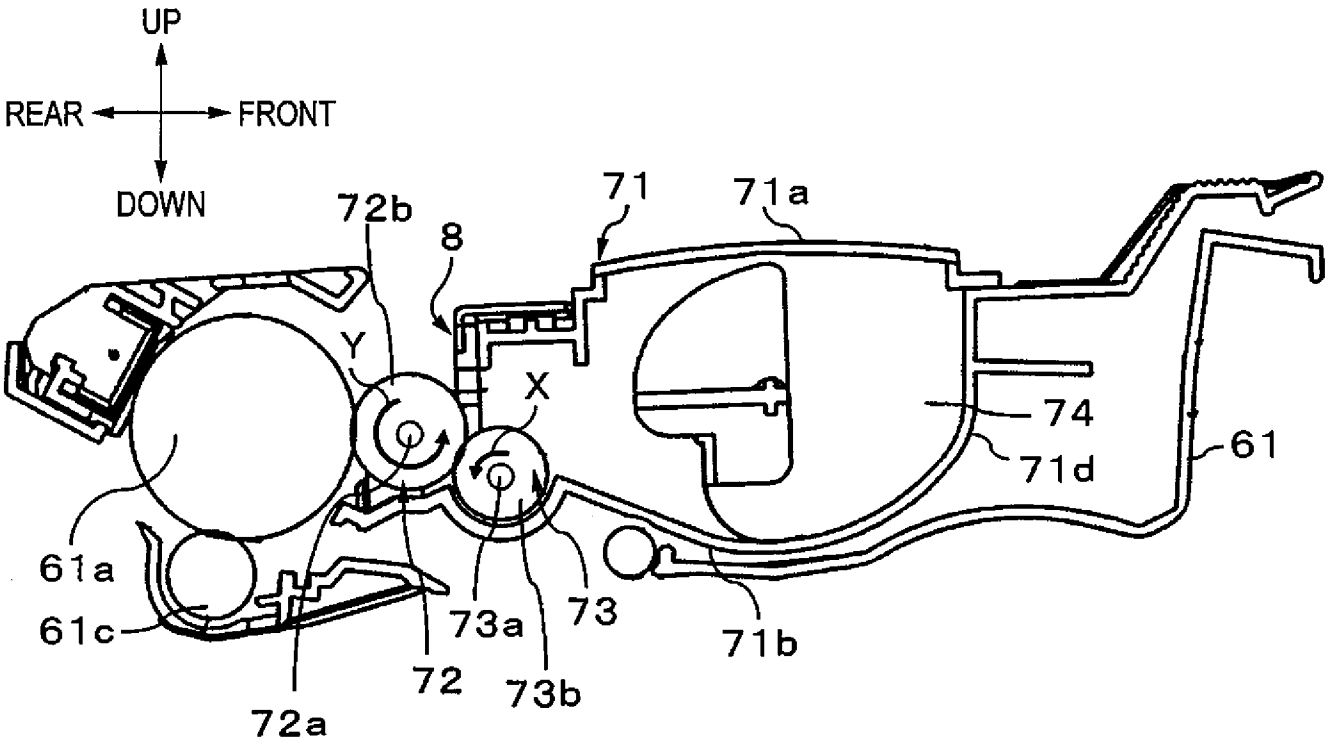
FIG. 3 is a side sectional view showing a schematic configuration of a process cartridge.

As shown in FIG. 3, the developing cartridge 7 has a developing cartridge frame 71 that is an example of the housing having an opening 71*e* formed thereto, which will be described later. The developing cartridge further has, in the developing cartridge frame 71, a developing roller 72 that carries toner, a supply roller 73 that supplies toner to the developing roller 72 and a toner accommodating part 74 that accommodates toner.

The developing roller 72 has a developing roller shaft 72*a* made of metal and extending in the left-right direction (a direction perpendicular to paper) and a developing roller main body 72*b* that covers the developing roller shaft 72*a*.

The developing roller shaft 72*a* is rotatably supported to the developing cartridge frame 71. The developing roller main body 72*b* is made of a conductive rubber material. The conductive rubber material is formed of conductive urethane rubber or silicon rubber including carbon particles and a surface thereof is covered with a coating layer of urethane rubber or silicon rubber including fluorine. The developing roller 72 is rotated in a Y direction (counterclockwise direction) about an axis line of the developing roller shaft 72*a*, which is a rotational axis.

The supply roller 73 has a supply roller shaft 73*a* made of metal and extending in the left-right direction and a supply roller main body 73*b* that covers the supply roller shaft 73*a*.

The supply roller shaft 73*a* is rotatably supported to the developing cartridge frame 71. The supply roller main body 73*b* is made of a conductive foam material. The supply roller 72 is rotated in an X direction (clockwise direction).

The toner accommodating part 74 is provided with an agitator for stirring toner in the toner accommodating part 74. The agitator extends in left-right direction in the toner accommodating part 74 and has a rotational shaft that is rotated by a driving source (not shown) and a stirring plate that protrudes radially from the rotational shaft. The agitator is configured to stir toner, which is accommodated in the toner accommodating part 74, by the stirring plate that is rotated together with the rotational shaft.

In addition, the toner accommodating part 74 accommodates pulverized toner of positively charged non-magnetic one component prepared by a so-called pulverization method.

In the process cartridge 6 configured as described above, the surface of the photosensitive drum 61*a* is uniformly charged by the charger, the charged surface of the photosensitive drum 61*a* is exposed to the scanning of laser light and potential of the exposed part is thus lowered, so that an electrostatic latent image is formed on the surface of the photosensitive drum 61*a*.

In the meantime, toner accommodated in the toner accommodating part 74 is supplied on the circumferential surface of the developing roller 72 by rotation of the supply roller 73. At this time, the toner is positively friction-charged between the supply roller 73 and the developing roller 72. As the developing roller 72 is rotated, the toner supplied on the developing roller 72 is introduced between a blade 81, which will be described later, and the developing roller 72, and is then carried, as a thin layer having a uniform thickness, on the developing roller 72.

The toner supplied from the developing cartridge 7 is held on the exposed part of the photosensitive drum 61*a*, so that a toner image is formed on the surface of the photosensitive drum 61*a*.

(2-3) Photographic Fixing Unit

The photographic fixing unit 10 is arranged at a rear side of the process cartridge 6 and has a heating roller 10*a* that is heated by a heat source and a pressing roller 10*b* that is press-contacted to the heating roller 10*a*.

In the photographic fixing unit 10 configured as described above, the toner image on the sheet is heat-fixed while the sheet passes through between the heating roller 10*a* and the pressing roller 10*b*.

(3) Sheet Discharge Unit

The sheet discharge unit 5 has sheet discharge rollers 51 for conveying the sheet having passed through the photographic fixing unit 10 and a sheet discharge tray 52 that accumulates the sheet conveyed from the sheet discharge rollers 51.

In the sheet discharge unit 5 configured as described above, the sheet that has been fixed in the photographic fixing unit 10, is conveyed by the sheet discharge rollers 51 and is discharged to the sheet discharge tray 52.

<Specific Configuration of Developing Cartridge>

Next, a specific configuration of the developing cartridge 7, which is a characteristic of the invention, will be described with reference to FIGS. 3 to 11.

As shown in FIG. 3, the developing cartridge 7 has the developing cartridge frame 71, the developing roller 72 and the supply roller 73. The developing cartridge further has a blade unit 8 that regulates a thickness of a toner layer carried on the circumferential surface of the developing roller 72 and a seal member 9 (refer to FIG. 9B) for preventing toner from being leaked from the opening 71*e*.

Figure 4:
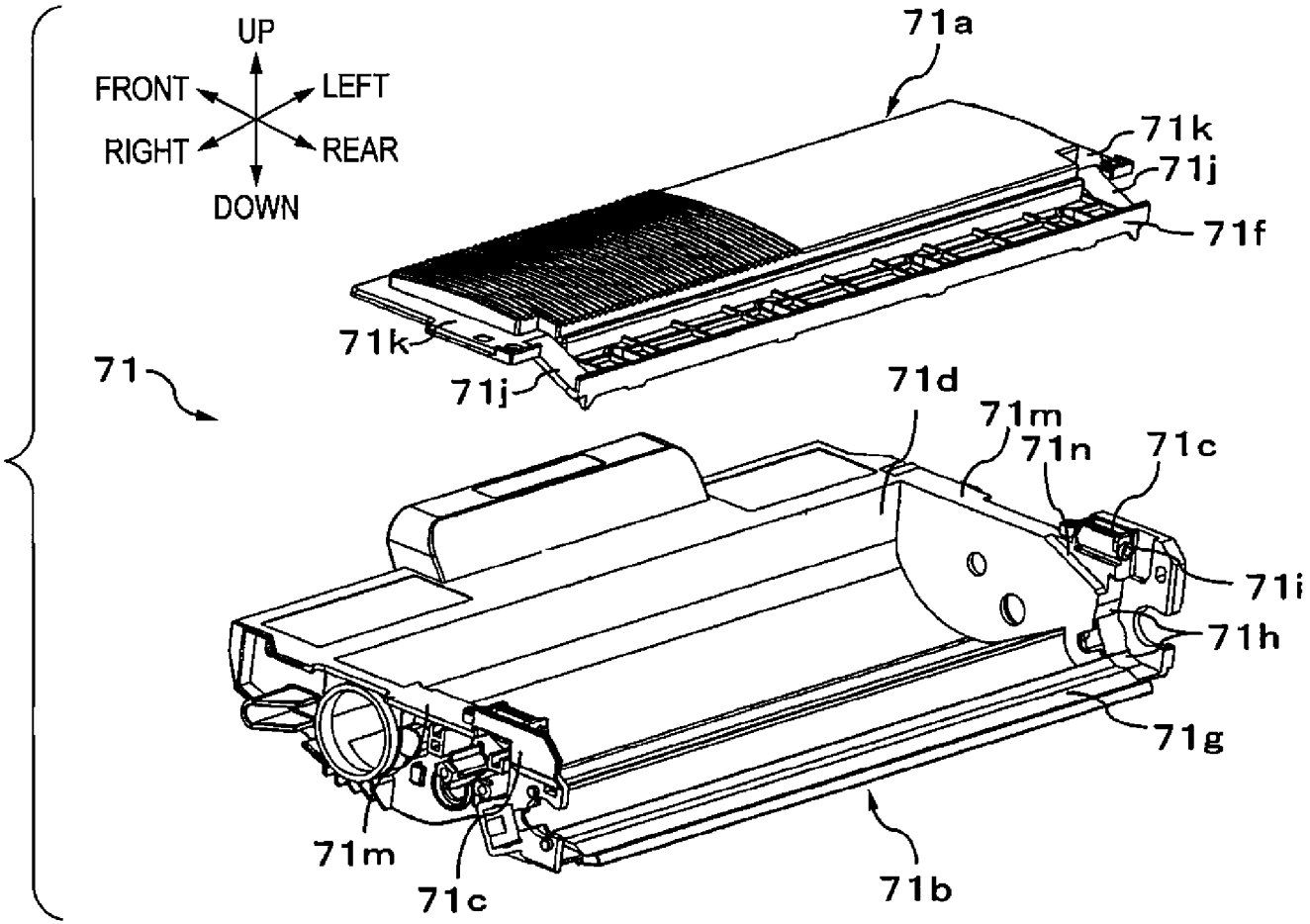
FIG. 4 is a perspective view showing a configuration of a developing cartridge frame.

As shown in FIG. 4, the developing cartridge frame 71 has a lower frame 71*b* and an upper frame 71*a*, which are opposed to each other in the upper-lower direction. The opening 71*e* (refer to FIG. 5) having a substantially rectangular shape, which is long in the left-right direction, is formed at the back side of the developing cartridge frame 71 by combining the upper frame 71*a* and the lower frame 71*b*.

The lower frame 71*b* has a pair of sidewalls 71*c* that is provided to block a space between the upper frame 71*a* and the lower frame 71*b* from both sides of the left-right direction and a front wall 71*d* that is provided to block a space between the upper frame 71*a* and the lower frame 71*b* from a front side. In addition, the lower frame 71*b* is formed at a rear end side thereof with a second adhesive portion 71*g* that extends in the left-right direction. An axial seal member 92, which will be described later, can be adhered to the second adhesive portion 71*g*.

Figure 5:
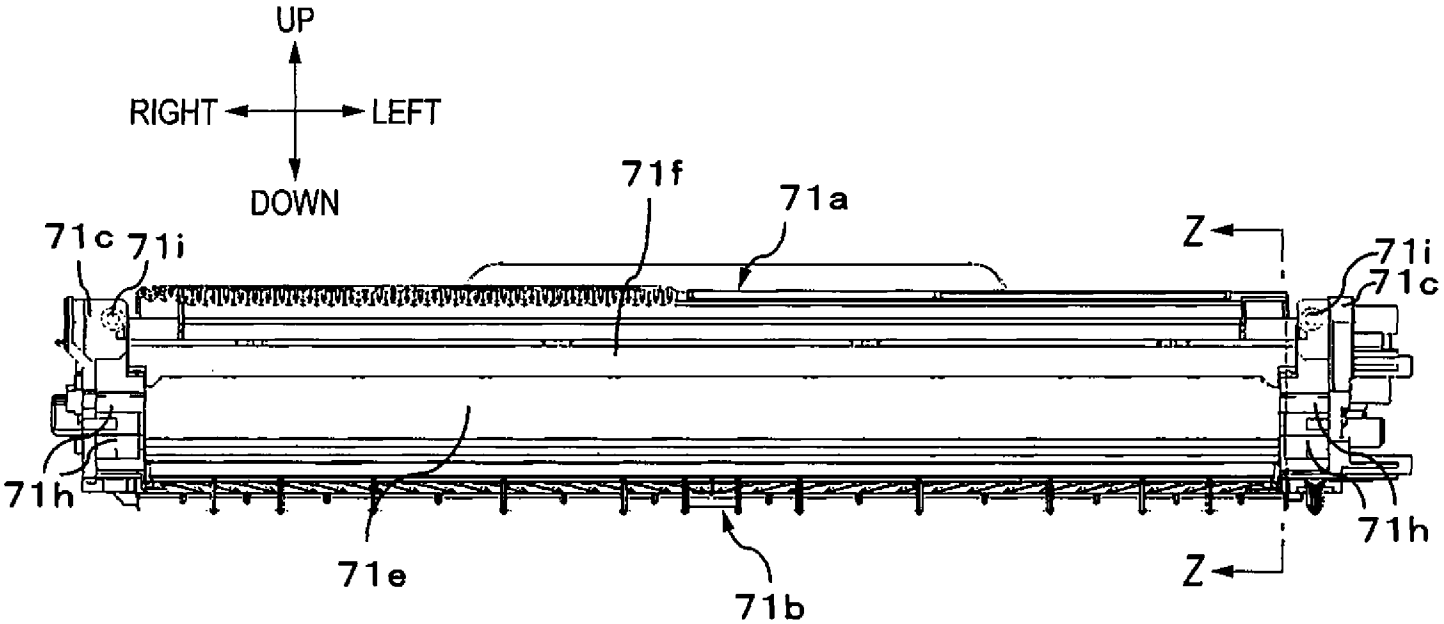
FIG. 5 is a rear view of a developing cartridge.

As shown in FIGS. 4 and 5, both sidewalls 71*c* are formed with fixing holes 71*i* for fixing the blade unit 8 to the developing cartridge frame 71, third adhesive portions 71*h* (only one side is shown in FIG. 4) provided to rear end sides (both end portions of the left-right direction of the opening 71*e*) of the sidewalls 71*c* and first welding surfaces 71*m* and second welding surfaces 71*n* for welding the upper frame 71*a* and the lower frame 71*b*, respectively.

The first welding surface 71*m* is comprised of an upper end face of the sidewall 71*c* and has a planar shape extending forward, backward, leftward and rightward.

The second welding surface 71*n* extends so that it continues from a rear end portion of the first welding surface 71*m* and is downwardly slanted toward a rear side.

The side seal member 93 that will be described later is adhered to the third adhesive portions 71*h*.

The upper frame 71*a* is formed with first contact portions 71*k*, second contact portions 71*j* and a first adhesive portion 71*f*.

Each of the first contact portions 71*k* has a flat plate shape corresponding to each of the first welding surfaces 71*m* of the sidewalls 71*c*. The first contact portions 71*k* are contacted to the first welding surface 71*m* when the upper frame 71*a* is assembled to the lower frame 71*b*. A surface of each of the first contact portions 71*k*, which is opposed to each of the first welding surfaces 71*m*, is formed with a rib for welding.

Each of the second contact portions 71*j* has a flat plate shape that continues from a rear end portion of each of the first contact portions 71*k* and is downwardly slanted toward a rear side so as to correspond to each of the second welding surfaces 71*n* of the sidewalls 71*c*. The second contact portions 71*j* are contacted to the second welding surfaces 71*n* when the upper frame 71*a* is assembled to the lower frame 71*b*. A surface of each of the second contact portions 71*j*, which is opposed to each of the second welding surfaces 71*n*, is formed with a rib for welding.

The first adhesive portion 71*f* has a flat plate shape that continues from rear end portions of the second contact portions 71*j* and extends upwardly. In addition, the first adhesive portion 71*f* extends in the left-right direction at the rear end portions of the second contact portions 71*j*.

Figure 6:
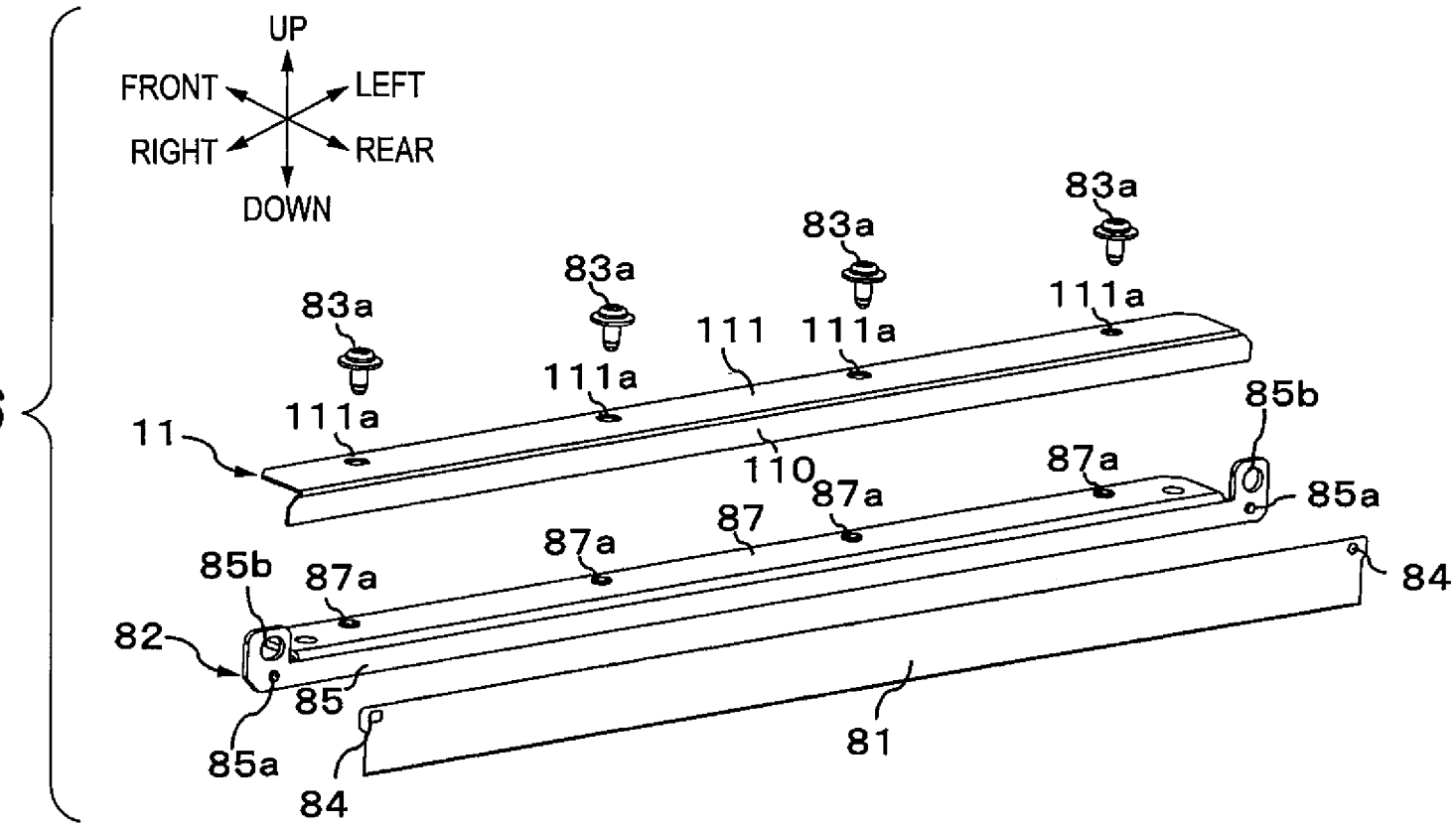
FIG. 6 illustrates a configuration of a blade unit.

As shown in FIG. 6, the blade unit 8 has a blade 81, which is an example of the layer thickness regulating member that sliding-contacts the circumferential surface of the developing roller 72 and regulates a thickness of a toner layer carried on the circumferential surface of the developing roller 72, a support member 82 that supports the blade 81, a fixing member 11 that fixes the blade 81 and screws 83*a* that fix the support member 82 and the fixing member 11.

Figure 7:
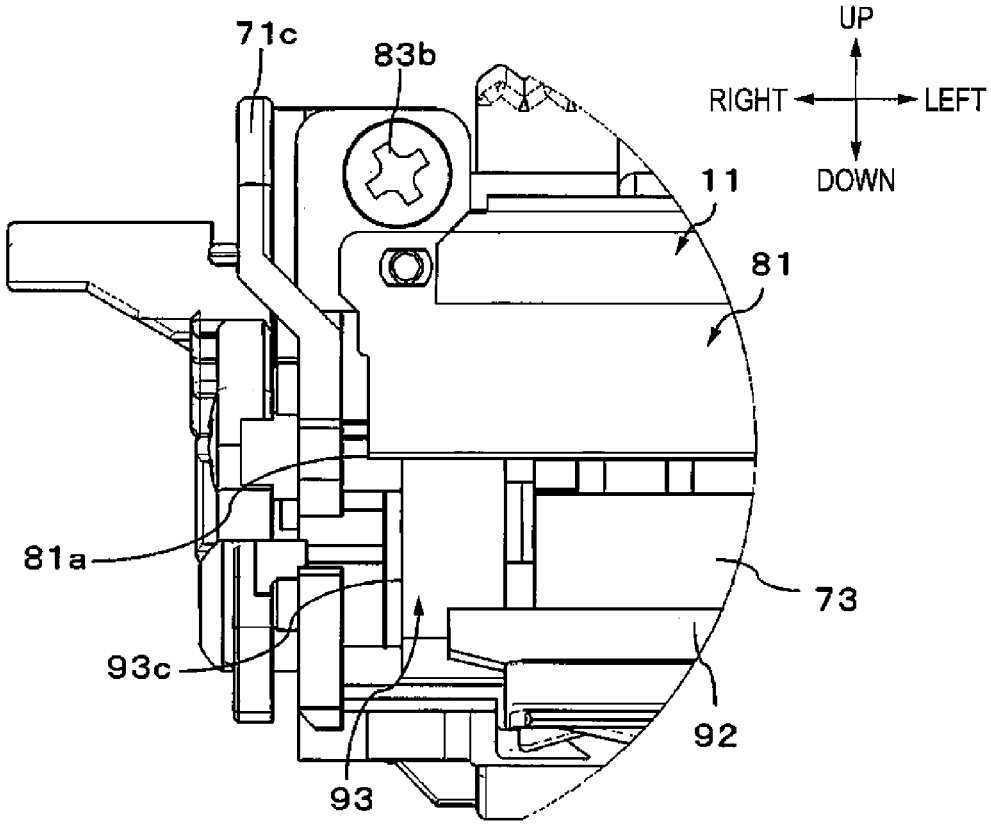
FIG. 7 is a back side view of the developing cartridge to which the blade unit is assembled.

The blade 81 is formed of a metal plate spring material such as stainless steel and has elasticity. As shown in FIG. 7, both end portions 81*a* of a lower end side of the blade 81 are configured to farther extend in the outer direction than outer end portions 93*c* of the side seal member 93 regarding the left-right direction (only one side is shown in FIG. 7).

As shown in FIG. 6, both end portions of an upstream end of the blade regarding the left-right direction are formed with first penetration holes 84, which are penetrated in a thickness direction (front-rear direction) of the blade 81, respectively.

Figure 8:
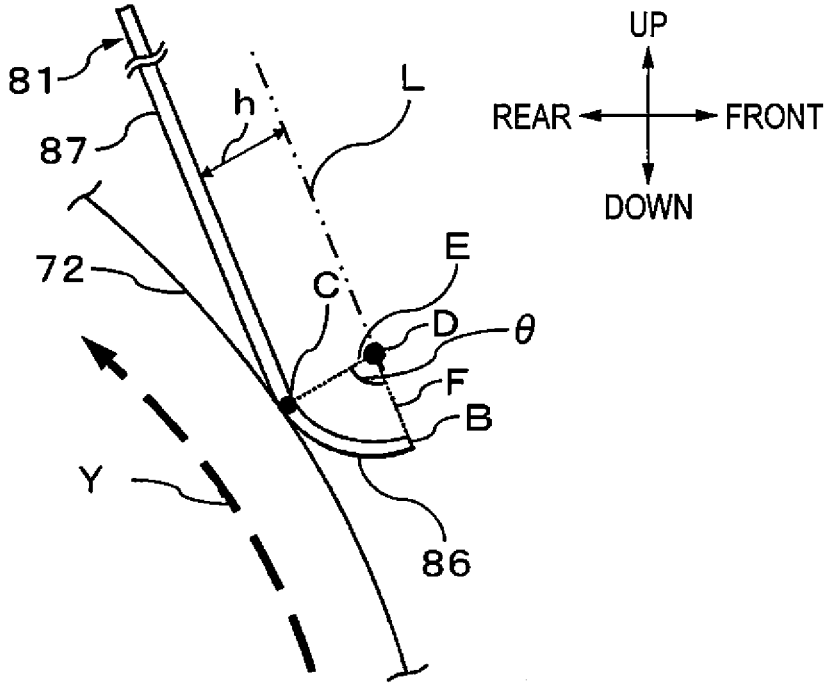
FIG. 8 is a sectional view showing a schematic configuration of a blade.

In addition, as shown in FIG. 8, the lower end portion of the blade 81 is formed with a bent portion 86 extending in the left-right direction, which is an example of the bent portion that is bent into a circular arc shape so as to get away from the developing roller 72. The bent portion 86 is a part from a bending start portion C to a leading end portion B and is spaced from the circumferential surface of the developing roller 72 as it faces the leading end portion B from the bending start portion C. In addition, the bent portion 86 is configured in such a way that an angle θ between a first base line E connecting a center of curvature D and the bending start portion C of the bent portion 86 and a second base line F connecting the center of curvature D and the leading end portion B of the bent portion 86 is within a range of $0° < \theta \leq 90°$. The bending start portion C of the bent portion 86 is a portion that contacts the circumferential surface of the developing roller 72.

More specifically, when seen from the left-right direction, the blade 81 has a straight-line portion 87 that straightly extends downwardly from a base end and the bent portion 86 that is formed to have a radius of curvature of 0.35 mm about the center of curvature D from the bending start portion C, which is a lower end of the straight-line portion 87, toward the leading end portion B and is bent into a circular arc in a direction getting away from the developing roller 72.

In addition, the bent portion 86 is formed in such a way that the angle θ between the first base line E and the second base line F is about 90°. Like this, the angle θ between the first base line E and the second base line F is made to be about 90°, so that a surface of the bent portion 86 facing the developing roller 72 enables toner, which is carried on the developing roller 72, to be introduced to a contact portion between the developing roller 72 and the bending start portion C.

As shown in FIG. 6, the support member 82 is formed by bending a metal plate elongated in the left-right direction into an L shape when projected from the left-right direction, and has integrally a first support part 85 and a second support part 87.

The first support part 85 has a substantially rectangular plate shape that is thin in the front-rear direction and is elongated in the left-right direction. Both end portions of a back side face of the first support part 85 regarding the left-right direction are formed with convex portions 85*a* protruding backward and second penetration holes 85*b* that are penetrated in a thickness direction (front-rear direction) of the first support part 85.

The convex portions 85*a* are formed at positions that face the first penetration holes 84 when the blade 81 is assembled to the first support part 85.

The second support part 87 has a substantially rectangular shape that is thin in the upper-lower direction and is elongated in the left-right direction when seen from a plan view. The second support part 87 is formed with a plurality of screw holes 87*a* (four screw holes in this illustrative embodiment), which are penetrated in a thickness direction (upper-lower direction) of the second support part, at a predetermined interval in the left-right direction.

Like the support member 82, the fixing member 11 is formed by bending a metal plate elongated in the left-right direction into an L shape when projected from the left-right direction, and has integrally a first fixing part 110 and a second fixing part 111.

The first fixing part 110 has a substantially rectangular shape that is thin in the front-rear direction and is elongated in the left-right direction when seen a rear view. A size of the left-right direction thereof is the substantially same as that of the second support part 87.

The second fixing part 111 has a substantially rectangular shape that is thin in the upper-lower direction and is elongated in the left-right direction when seen a plan view. A size of the left-right direction thereof is the substantially same as that of the upper end portion of the first fixing part 110.

The second fixing part 111 is formed with a plurality of third penetration holes 111*a* (four penetration holes in this illustrative embodiment), which are penetrated in a thickness direction (upper-lower direction) of the second fixing part 111, at a predetermined interval in the left-right direction. An interval between the third penetration holes 111*a* adjacent to each other in the left-right direction is the same as an interval between the screw holes 87*a* adjacent to each other in the left-right direction, which are formed at the second support part 87.

<Assembling of Blade Unit>

Next, a method of assembling the blade unit 8 will be described (refer to FIG. 6).

When assembling the blade unit 8, the blade 81, the support member 82 and the fixing member 11 are postured as shown in FIG. 6.

Then, the convex portions 85*a* of the first support part 85 are inserted and positioned into the first penetration holes 84 of both end portions of the blade 81.

Then, when the second fixing part 111 is contacted to the second support part 87 from an upper side, the first fixing part 110 is opposed to a substantially half part of the blade 81 from a back side. At this time, the second penetration holes 111*a* and the screw holes 87*a* are matched.

Under such state, the screws 83*a* are respectively inserted into the second penetration holes 111*a* from an upper side, so that the blade 81 is fixed between the first support part 85 and the first fixing part 110.

Thereby, the upper part of the blade 81 is sandwiched by the support member 82 and the fixing member 11, so that the assembling of the blade unit 8 is completed.

<Configuration of Seal Member>

Figure 9B:
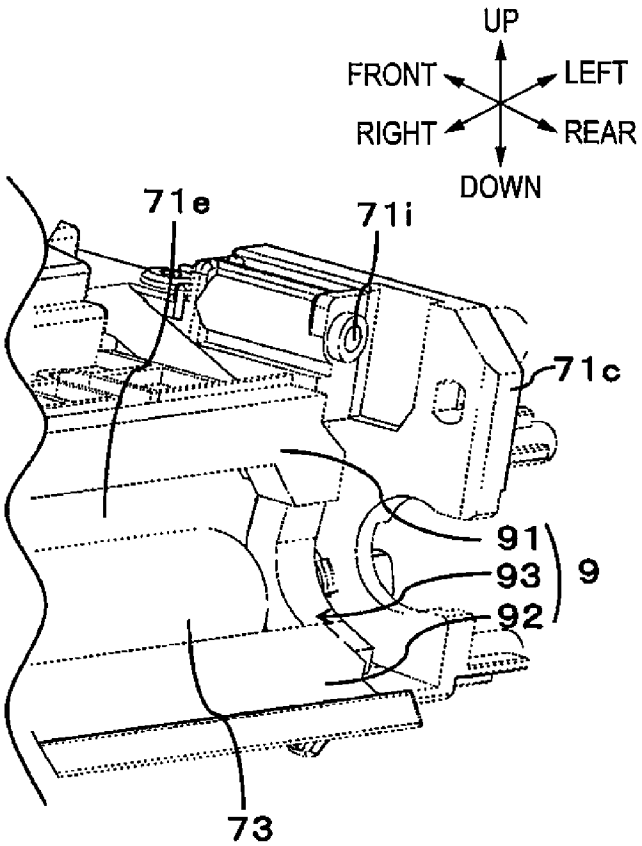
FIG. 9A is an enlarged view of a rear end portion of a Z-Z section when a seal member and the like are assembled to the developing cartridge frame and FIG. 9B is a perspective view showing a state in which the seal member is adhered to the developing cartridge frame.
Figure 9A:
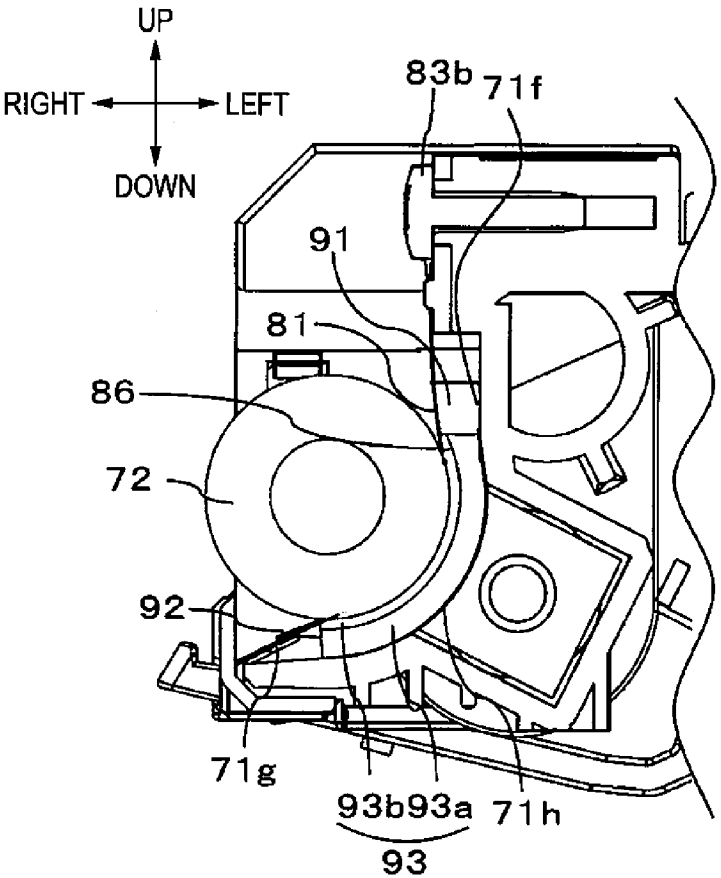

Next, a configuration of the seal member will be described with reference to FIG. 9. FIG. 9A is an enlarged view of a rear end portion of a Z-Z section of FIG. 5 when the seal member and the like are assembled to the developing cartridge frame. In the meantime, a hatching is omitted in FIG. 9A.

The seal member 9 has a blade backside seal member 91 that suppresses toner leakage through a gap between the blade 81 of the blade unit 8 and the first adhesive portion 71*f*, an axial seal member 92 that suppresses toner leakage from a gap between the circumferential surface of the developing roller 72 and the second adhesive portion 71*g* and a side seal member 93 that suppresses toner leakage from gaps between the third adhesive portions 71*h* and both end portions of the circumferential surface of the developing roller 72.

The blade backside seal member 91 is made of a sponge material such as urethane foam and the like and is adhered to the first adhesive portion 71*f* by a double-sided tape. A length of the left-right direction of the blade backside seal member 91 is configured to substantially same as that of the first adhesive portion 71*f*.

The axial seal member 92 is made of a flexible material such as PET (polyethylene terephthalate) sheet, rubber sheet and the like, for example. The axial seal member 92 is adhered to the second adhesive portion 71*g* by a double-sided tape and the like. The axial seal member 92 is a film having a substantially rectangular shape that is elongated in the left-right direction.

As shown in FIG. 9A, the side seal member 93 has two layers of a base layer 93*a* having elasticity and a sliding contact layer 93*b* that is an example of the sliding contact portion provided to a surface of the base layer 93*a* facing the developing roller 72.

The base layer 93*a* is made of an elastic body such as urethane sponge and the like and is adhered to the third adhesive portions 71*h* by a double-sided tape.

Figure 10B:
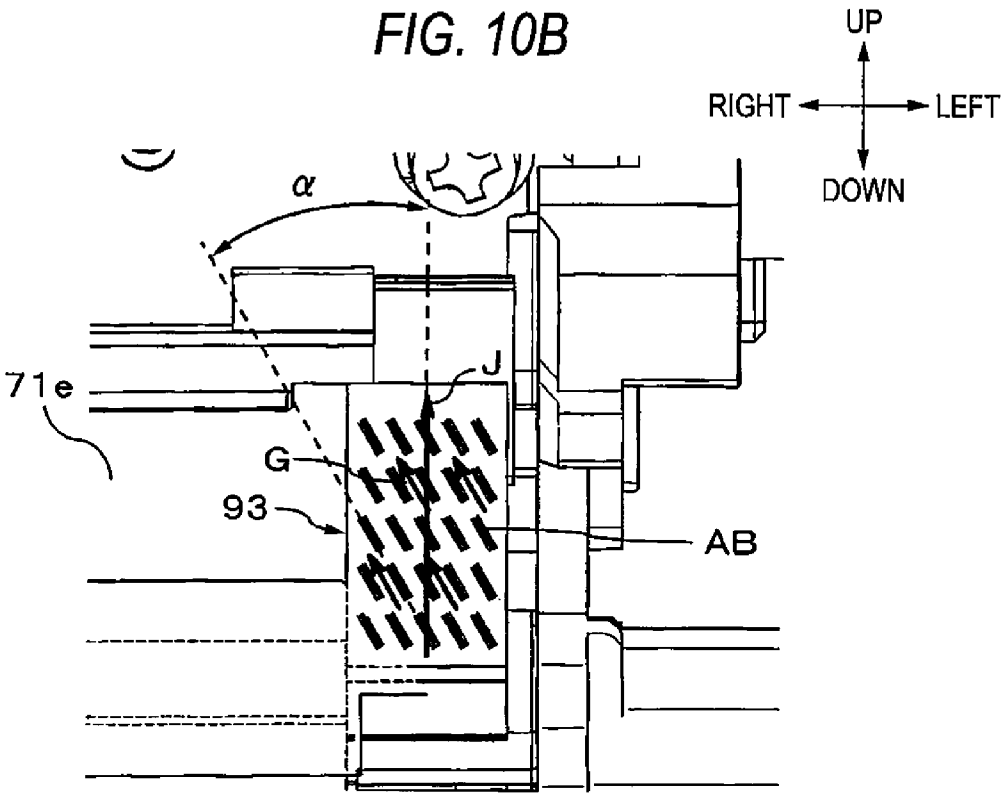
FIG. 10A illustrates a configuration of a side seal member and FIG. 10B is a front view showing a configuration of the side seal member.
Figure 10A:
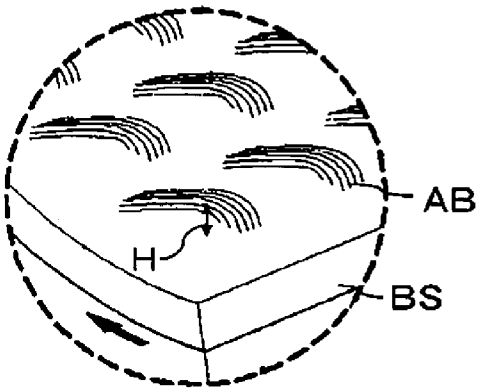

As shown in FIG. 10A, the sliding contact layer 93*b* is configured by transplanting a plurality of raised fabrics A, which is an example of the raised fabric, into a base sheet BS. A surface of the base sheet BS of the sliding contact layer 93*b* is adhered to the base layer 93*a* by a double-sided tape. The sliding contact layer 93*b* is configured in such a way that a thickness H (refer to FIGS. 10A and 11) between the base sheet BS and an upper end of a bundle AB of the raised fabrics under state in which the bundle AB of raised fabrics falls down is thicker than a height (thickness of the bent portion) h between the straight-line portion 87 and a virtual line L passing to the leading end portion B of the bent portion 86 and parallel with the straight-line portion 87 (refer to FIG. 11).

More specifically, as shown in FIG. 10B, the sliding contact layer 93*b* has a plurality of arranged bundles AB of raised fabrics, each of which is configured by bundling the plurality of raised fabrics A. Although the bundles AB of raised fabrics are arranged at a predetermined interval in FIG. 10, the bundles AB of raised fabrics are actually arranged more densely. The respective bundles AB of raised fabrics fall down in an oblique direction (G direction) toward the opening 71*e* (toward the inside) as they face the downstream side (J direction in FIG. 10B) of the rotational direction of the developing roller 72. An angle α between the J direction and the G direction is preferably within a range of $30° \leq \alpha \leq 60°$. In addition, the thickness H of the sliding contact layer 93*b* is about 1.1 mm and a density of the raised fabrics is about 120,000/$in^2$. By this configuration, when assembling the developing roller 72 to the developing cartridge frame 71, it is possible to fill a space between the developing roller 72 and the base sheet BS at the upstream side of the rotational direction of the developing roller 72.

<Assembling of Blade Unit to Developing Cartridge Frame>

Figure 11B:
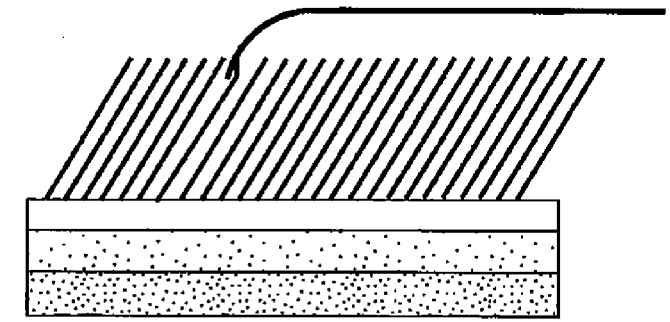
FIG. 11A, FIG. 11B and FIG. 11C are illustrate a relation between a bent portion and the side seal member when the blade unit is assembled.
Figure 11A:
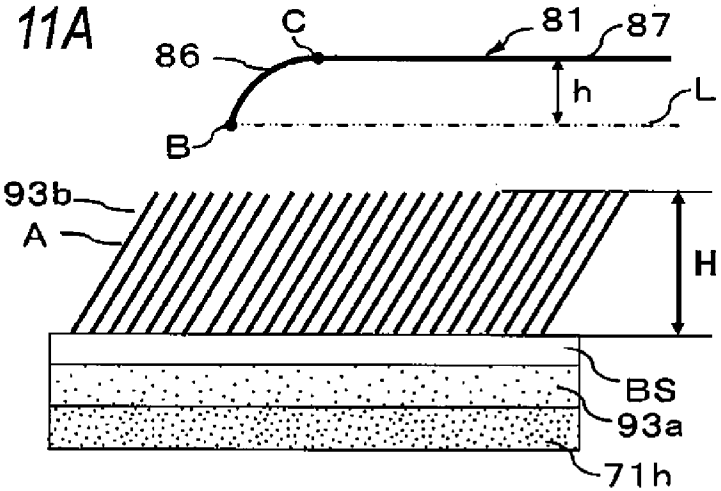

Next, the assembling of the blade unit 8 to the developing cartridge frame 71 will be described with reference to FIG. 11.

First, the blade unit 8 is set so that the second penetration holes 85*b* of the blade unit 8 are matched with the fixing holes 71*i* formed at the sidewalls 71*c*. Then, screws 83*b* are inserted into the second penetration holes 85*b* and the fixing holes 71*i*, thereby fixing the blade unit 8 to the developing cartridge frame 71 (refer to FIG. 9A).

At this time, the leading end portion B of the bent portion 86 is contacted to the sliding contact layer 93*b* of the side seal member 93. When the blade unit 8 is fixed to the developing cartridge frame 71, the leading end portion B of the bent portion 86 is introduced between the raised fabric A and the raised fabric A of the sliding contact layer 93*b* having the concentrated raised fabrics A, as shown in FIG. 11B.

Figure 11C:
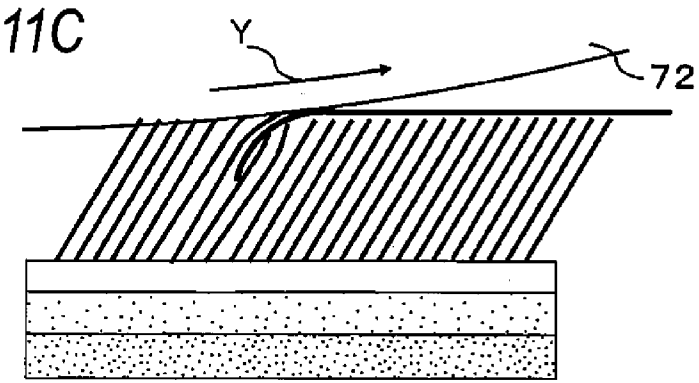

When the assembling of the blade unit 8 is completed and the developing roller 72 is assembled, the blade 81 is pressed by the developing roller 72 and the bent portion 86 is further introduced into the sliding contact layer 93*b*, as shown in FIG. 11C. Then, the raised fabrics A of the sliding contact layer 93*b* fill spaces between the blade 81 and the third adhesive portions 71*h* at the more downstream side of the rotational direction of the developing roller 72 than the leading end portion B of the blade 81 and spaces between the developing roller 72 and the third adhesive portions 71*h* at the more upstream side of the rotational direction of the developing roller 72 than the leading end portion B of the blade 81.

<Operational Effects>

The effects of the laser printer configured as described above will be described.

According to the configuration of the conventional side seal member, both the downstream-side seal member arranged downstream of the rotational direction of the developing roller and the upstream-side side seal member arranged upstream of the rotational direction of the developing roller sandwich the leading end portions of both ends of the bent portion, thereby suppressing toner leakage. Contrary to this, according to the invention, the side seal member 93 has the sliding contact layer 93*b* formed of the raised fabrics A. Thus, only the raised fabrics A of the sliding contact layer 93*b* fill the spaces between the blade 81 and the third adhesive portions 71*h* at the more downstream side of the rotational direction of the developing roller 72 than the leading end portion B of the bent portion of the blade 81 and the spaces between the circumferential surface of the developing roller 72 and the third adhesive portions 71*h* at the more upstream side of the rotational direction of the developing roller 72 than the leading end portion B of the blade 81. As a result, the high positioning precision is not required when assembling the side seal member 93 to the developing cartridge frame 71.

In addition, the bent portion 86 is configured in such a way that the angle θ between the first base line E connecting the center of curvature D and the bending start portion C of the bent portion 86 and the second base line F connecting the center of curvature D and the leading end portion B of the bent portion 86 is within a range of $0° < \theta \leq 90°$.

For example, when the bent portion is configured so that the angle θ between the first base line E and the second base line F is 180°, the sliding contact layer 93*b* is difficult to enter a space formed by the angle θ ($90° < \theta \leq 180°$) between the first base line E and the second base line F of the bent portion 86, so that a space is easily generated. In other words, when the angle θ between the first base line E and the second base line F is made to be within a range of $0° < \theta \leq 90°$, the sliding contact layer 93*b* can easily fill the spaces between the bent portion 86 and the third adhesive portions 71*h* while following the shape of the bent portion 86, so that it is possible to further prevent toner leakage.

In addition, since the sliding contact layer 93*b* is made of the raised fabrics such as raised fabrics A, the raised fabrics A can easily fill the spaces between the bent portion 86 of the blade 81 and the third adhesive portions 71*h* and the spaces between the circumferential surface of the developing roller 72 and the third adhesive portions 71*h*. Thereby, it is possible to further prevent toner leakage.

Further, the sliding contact layer 93*b* has the plurality of arranged bundles AB, each of which is configured by bundling the plurality of raised fabrics A, and the respective bundles AB of raised fabrics fall down in an oblique direction toward the opening (toward the inside) as they face the downstream side of the rotational direction of the developing roller 72. Thereby, it is possible to convey the toner, which has been introduced in the side seal member 93, so that it returns to the opening 71*e*.

Both end portions 81*a* of the lower end of the blade 81 are configured to farther extend in the outer direction than the outer end portions 93*c* of the side seal member 93 regarding the left-right direction. Accordingly, the spaces between the third adhesive portions and the circumferential surface of the developing roller and the blade 81 are filled up to the outer end portions 93*c* of the side seal member 93 regarding the left-right direction. Thereby, even when toner is introduced from the surfaces of the inner ends of the side seal member 93 regarding the left-right direction, the toner is enabled to stay in the side seal member and thus is less leaked.

<Modified Embodiments>

In the above illustrative embodiment, the sliding contact layer 93*b* is configured by transplanting the raised fabrics A into the base sheet BS. However, the sliding contact layer may be configured by a felt member. FIG. 12 illustrates a relation between the bent portion 86 and the side seal member 93 when assembling the blade unit 8 to the developing cartridge frame 71 in a configuration in which the sliding contact layer 93*b* is made of a felt member.

The bent portion 86 is configured in such a way that the angle θ between the first base line E connecting the center of curvature D and the bending start portion C of the bent portion 86 and the second base line F connecting the center of curvature D and the leading end portion B of the bent portion 86 is within a range of $0° < \theta \leq 90°$.

The sliding contact layer 93*b* is formed so that a thickness H of the felt member is thicker than the thickness h of the bent portion.

Figure 12B:
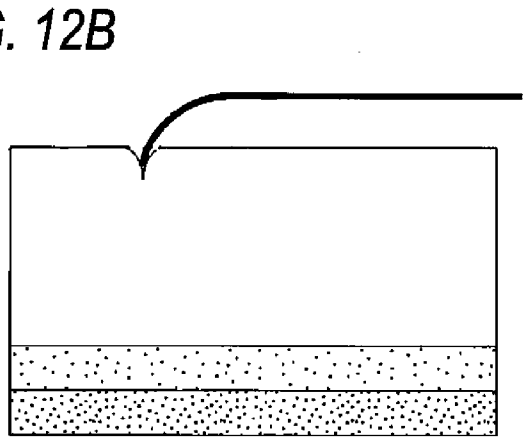
FIG. 12A, FIG. 12B and FIG. 12C illustrate a relation between a side seal member of a modified embodiment and the bent portion when the blade unit is assembled.
Figure 12A:
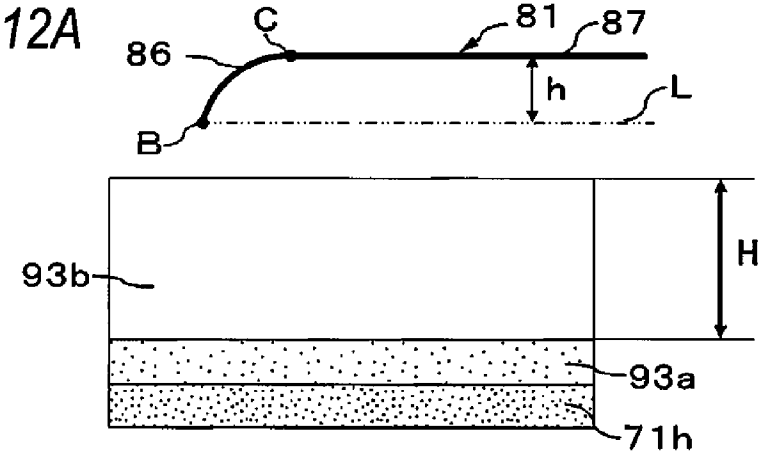
Figure 12C:
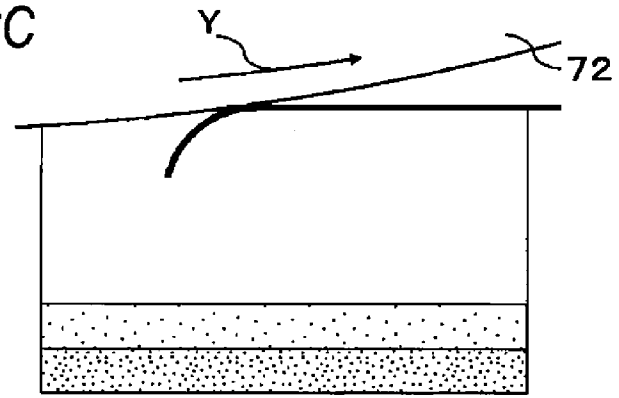

When the blade unit 8 is assembled to the developing cartridge frame 71, the leading end portion B of the bent portion 86 is introduced into the felt member, as shown in FIG. 12B. Then, when the developing roller 72 is assembled to the developing cartridge frame, the felt member fills the space between the blade and the base layer at the more downstream side of the rotational direction of the developing roller 72 than the leading end portion B of the bent portion 86 (refer to FIG. 11C). When the developing roller 72 is rotated, the fabrics of the felt member extend in the rotational direction of the developing roller 72, thereby filling the space between the developing roller 72 and the sliding contact layer 93*b*.

In addition, since the sliding contact layer 93*b* is configured by the felt member, it is possible to stably prevent the toner leakage without managing the raised fabrics when manufacturing or assembling the seal member, compared to the raised fabrics.

Figure 13:
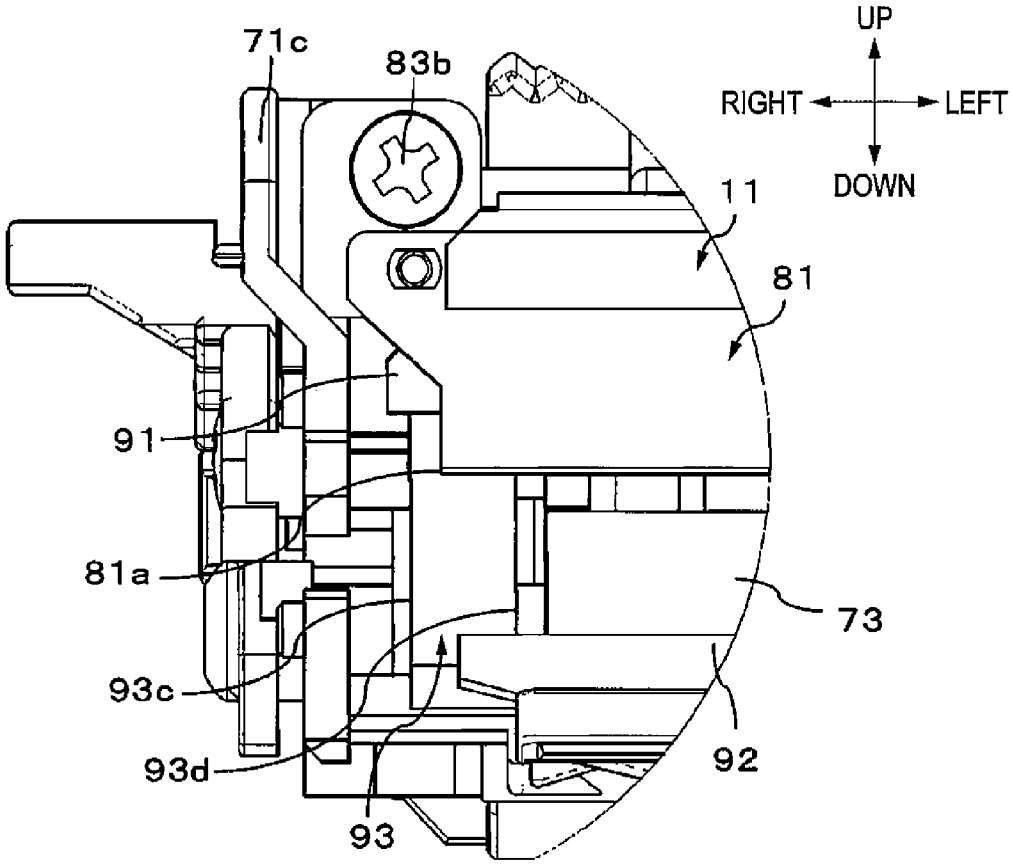
FIG. 13 illustrates a configuration of a blade of a modified embodiment.

In the above illustrative embodiment, both end portions 81*a* of the lower end of the blade 81 are configured to farther extend in the outer direction than the outer end portions 93*c* of the side seal member 93 regarding the left-right direction. However, both end portions 81*a* of the lower end of the blade 81 may be in the side seal member 93 (between the outer end portions 93*c* and inner end portions 93*d* of the side seal member 93) (refer to FIG. 13. Only one side is shown in FIG. 13). By this configuration, it is possible to reduce a contact portion between a part of the circumferential surface of the developing roller 72, on which the toner is not put, with respect to the rotational axis line and the bent portion 86 of the blade 81, so that it is possible to reduce frictional resistance between the developing roller 72 and the bent portion 86.

In the above illustrative embodiment, the side seal member 93 is adhered to the third adhesive portions 71*h* by the double-sided tape. However, the same effect can be realized even with a configuration in which portions corresponding to the third adhesive portions 71*h* are recessed and the side seal member 93 is fitted into the recessed portions.

In the meantime, the illustrative embodiments of the invention are not limited to the above illustrative embodiments and various embodiments can be adopted without departing from a technical scope of the invention.

<Overview of the Present Invention>

According to a first aspect of the present invention, there is provided a developing apparatus comprising: a housing having an opening; a developing roller that is arranged so that a part of a circumferential surface of the developing roller is opposed to the opening of the housing, is rotatably supported to the housing and carries developer on the circumferential surface of the developing roller; a seal member that is fixed to the housing to be opposed to the developing roller in both end portions of the opening in a rotational axis line of the developing roller and sliding-contacts the circumferential surface of the developing roller, and a layer thickness regulating member that contacts the circumferential surface of the developing roller via developer and regulates a thickness of a developer layer on the circumferential surface of the developing roller, wherein the seal member has a sliding contact portion made of fiber having elasticity and sliding-contacting the circumferential surface of the developing roller, wherein the layer thickness regulating member has one end portion that is supported by the housing and the other end portion to which a bent portion is formed to face the seal member, and wherein the bent portion is configured to enter the sliding contact portion.

According to a second aspect of the present invention, in addition to the first aspect, a thickness of the sliding contact portion is thicker than that of the bent portion.

According to a third aspect of the present invention, in addition to the first aspect, the bent portion is bent to have such a radius of curvature that an entire bent portion from a bending start portion to a leading end portion thereof is spaced from the circumferential surface of the developing roller, and wherein an angle θ between a first base line connecting a center of curvature and the bending start portion of the bent portion and a second base line connecting the center of curvature and the leading end portion is formed to be within a range of $0° < \theta \leq 90°$.

According to a fourth aspect of the present invention, in addition to the first aspect, the sliding contact portion is made of raised fabrics.

According to a fifth aspect of the present invention, in addition to the fourth aspect, the raised fabrics are obliquely inclined toward an inside of the housing as the fabrics face a downstream side of a rotational direction of the developing roller.

According to a sixth aspect of the present invention, in addition to the first aspect, the sliding contact portion is made of a felt member.

According to a seventh aspect of the present invention, in addition to the first aspect, an end portion of the bent portion in the rotational axis line farther extend over an outer end portion of the seal member in the rotational axis line.

According to an eighth aspect of the present invention, in addition to the first aspect, an end portion of the bent portion in the rotational axis line extend to a position between an outer end portion and an inner end portion of the seal member in the rotational axis line.

According to a ninth aspect of the present invention, there is provided a process cartridge comprising: the developing apparatus according to first aspect, and a photosensitive member to which developer is supplied from the developing apparatus and a developer image is formed.

According to a tenth aspect of the present invention, there is provided an image forming apparatus that forms an image on a sheet, the apparatus comprising: the process cartridge according to the ninth aspect; an exposure apparatus that scans light on the photosensitive member; a transfer unit that transfers a developer image formed by the process cartridge on a sheet, and a fixing unit that fixes the developer image formed on the sheet.

According to the invention of the first aspect, since the seal member has the sliding contact portion made of fiber having elasticity and the bent portion is configured to enter the sliding contact portion, the fiber easily fills a space between the housing and the developing roller and a space between the housing and the layer thickness regulating member by enabling the bent portion to enter the sliding contact portion. Thereby, when assembling the seal member, a space is hard to be generated and it is possible to prevent toner leakage without requiring high positioning precision.

According to the invention of the second aspect, since a thickness of the sliding contact portion is thicker than that of the bent portion, the sliding contact portion can easily fill the space between the housing and the layer thickness regulating member.

According to the invention of the third aspect, the bent portion is bent to have such a radius of curvature that the entire bent portion from a bending start portion to a leading end portion thereof is spaced from the circumferential surface of the developing roller and an angle θ between a first base line connecting a center of curvature and the bending start portion of the bent portion and a second base line connecting the center of curvature and the leading end portion is formed to be within a range of $0° < \theta \leq 90°$. Thus, when the bent portion is enabled to enter the sliding contact portion, the sliding contact portion can easily fill the space between the layer thickness regulating member and the housing while following a shape of the layer thickness regulating member, so that it is possible to further prevent the toner leakage.

According to the invention of the fourth aspect, since the sliding contact portion is made of raised fabrics, the raised fabric can easily fill the space between the layer thickness regulating member and the housing and the space between the circumferential surface of the developing roller and the housing. Thereby, it is possible to further prevent the toner leakage.

According to the invention of the fifth aspect, the raised fabrics are obliquely inclined toward an inside of the housing as the fabrics face a downstream side of a rotational direction of the developing roller. Thus, when toner is introduced on a surface of the seal member, the toner is moved along the inclined direction of the raised fabrics. In other words, the toner is moved to return to the opening. Thereby, it is possible to further prevent the toner leakage.

According to the invention of the sixth aspect, the sliding contact portion is made of a felt member. Thus, when manufacturing or assembling the seal member, it is possible to stably prevent the toner leakage without managing a direction of the fabrics.

According to the invention of the seventh aspect, both end portions of the bent portion regarding the rotational axis line of the developing roller farther extend in an outer direction than outer end portions of the seal member regarding the rotational axis line. Accordingly, it is possible to lengthen a width of the sliding contact portion that fills the space between the layer thickness regulating member and the housing and the space between the circumferential surface of the developing roller and the housing. Thereby, it is possible to further prevent the toner, which is introduced on the surface of the seal member from the opening, from being leaked.

According to the invention of the eighth aspect, both end portions of the bent portion regarding the rotational axis line of the developing roller extend to between outer end portions and inner end portions of the seal member regarding the rotational axis line. Therefore, it is possible to reduce a contact portion between a part of the circumferential surface of the developing roller, on which the toner is not put, with respect to the rotational axis line and the bent portion, so that it is possible to reduce frictional resistance between the developing roller and the layer thickness regulating member.

According to the invention of the ninth aspect, the process cartridge includes the developing apparatus according to the first aspect, it is possible to realize the same effects described with regard to the first aspect.

According to the invention of the tenth aspect, the image forming apparatus has the process cartridge according to the ninth aspect. Thus, it is possible to realize the same effect described with regard to ninth aspect.

What is claimed is:

1. A developing apparatus comprising:

a housing having an opening;

a developing roller that is arranged so that a part of a circumferential surface of the developing roller is opposed to the opening of the housing, is rotatably supported to the housing and is configured to carry developer on the circumferential surface of the developing roller;

a seal member that is fixed to the housing to be opposed to the developing roller in both end portions of the opening in a rotational axis direction of the developing roller and is configured to sliding-contact the circumferential surface of the developing roller; and a layer thickness regulating member configured to contact the circumferential surface of the developing roller via developer and to regulate a thickness of a developer layer on the circumferential surface of the developing roller, wherein the seal member comprises:

a base made of an elastic body;

a sliding contact portion made of fiber having elasticity and extended from the base, wherein the sliding contact portion is configured to sliding-contact the circumferential surface of the developing roller, wherein the layer thickness regulating member has a first end portion that is supported by the housing, an intermediate portion, and a second end portion, wherein the layer thickness regulating member is bent from the intermediate portion to the second end portion to face the seal member, wherein, in a region between the first end portion and the intermediate portion, the fiber of the sliding contact portion fills spaces between the layer thickness regulating member and the base; and in a region between the intermediate portion and the second end portion, the fiber of the sliding contact portion is positioned (i) between the base and the layer thickness regulating member and (ii) between the layer thickness regulating member and the developing roller wherein the bent portion is bent to have such a radius of curvature that an entire bent portion from the intermediate portion to the second end portion thereof is spaced from the circumferential surface of the developing roller, and wherein an angle θ between a first base line connecting a center of curvature and the intermediate portion and a second base line connecting the center of curvature and the second end portion is within a range of $0° < \theta \leq 90°$.

2. The developing apparatus according to claim 1, wherein a thickness of the sliding contact portion is thicker than that of the bent portion.

3. The developing apparatus according to claim 1, wherein the sliding contact portion is made of raised fabrics.

4. The developing apparatus according to claim 3, wherein the raised fabrics are obliquely inclined toward an inside of the housing as the fabrics face a downstream side of a rotational direction of the developing roller.

5. The developing apparatus according to claim 1, wherein the sliding contact portion is made of a felt member.

6. The developing apparatus according to claim 1, wherein an end portion of the bent portion in the rotational axis direction extends over an outer end portion of the seal member in the rotational axis direction.

7. The developing apparatus according to claim 1, wherein an end portion of the bent portion in the rotational axis direction extends to a position between an outer end portion and an inner end portion of the seal member in the rotational axis direction.

8. A process cartridge comprising:

the developing apparatus according to claim 1, and a photosensitive member to which developer is supplied from the developing apparatus and a developer image is formed.

9. An image forming apparatus that forms an image on a sheet, the apparatus comprising:

the process cartridge according to claim 8;

an exposure apparatus that scans light on the photosensitive member;

a transfer unit that transfers a developer image formed by the process cartridge on a sheet, and a fixing unit that fixes the developer image formed on the sheet.

* * * * *